US008017568B2

(12) United States Patent
Clark et al.

(10) Patent No.: US 8,017,568 B2
(45) Date of Patent: Sep. 13, 2011

(54) CLEANING RESIDUES FROM SEMICONDUCTOR STRUCTURES

(75) Inventors: Shan C. Clark, Forest Grove, OR (US); Vijayakumar S. Ramachandrarao, Hillsboro, OR (US); Robert B. Turkot, Jr., Hillsboro, OR (US)

(73) Assignee: Intel Corporation, Santa Clara, CA (US)

( * ) Notice: Subject to any disclaimer, the term of this patent is extended or adjusted under 35 U.S.C. 154(b) by 1477 days.

(21) Appl. No.: 10/376,874

(22) Filed: Feb. 28, 2003

(65) Prior Publication Data

US 2004/0171502 A1 Sep. 2, 2004

(51) Int. Cl.
*C11D 7/50* (2006.01)

(52) U.S. Cl. ..... 510/175; 134/1.3

(58) Field of Classification Search ..... 134/902, 134/1, 2, 31, 1.3, 34; 8/142; 510/175
See application file for complete search history.

(56) References Cited

U.S. PATENT DOCUMENTS

| | | | | |
|---|---|---|---|---|
| 4,861,497 | A * | 8/1989 | Welch et al. | 210/759 |
| 5,013,366 | A * | 5/1991 | Jackson et al. | 134/1 |
| 5,236,602 | A * | 8/1993 | Jackson | 210/748 |
| 5,306,350 | A * | 4/1994 | Hoy et al. | 134/22.14 |
| 6,242,165 | B1 * | 6/2001 | Vaartstra | 430/329 |
| 6,521,466 | B1 * | 2/2003 | Castrucci | 438/5 |
| 6,596,093 | B2 * | 7/2003 | DeYoung et al. | 134/36 |
| 6,602,351 | B2 * | 8/2003 | DeYoung et al. | 134/36 |
| 6,764,552 | B1 * | 7/2004 | Joyce et al. | 134/3 |
| 6,805,801 | B1 * | 10/2004 | Humayun et al. | 210/663 |
| 6,875,902 | B2 * | 4/2005 | Hori et al. | 588/249 |
| 6,955,799 | B1 * | 10/2005 | Parrish | 423/400 |
| 7,219,677 | B1 * | 5/2007 | Jackson | 134/94.1 |
| 2003/0125225 | A1 * | 7/2003 | Xu et al. | 510/175 |
| 2004/0071873 | A1 * | 4/2004 | DeYoung et al. | 427/248.1 |

* cited by examiner

*Primary Examiner* — Gregory E Webb
(74) *Attorney, Agent, or Firm* — Trop, Pruner & Hu, P.C.

(57) ABSTRACT

Supercritical carbon dioxide may be utilized to remove resistant residues such as those residues left when etching dielectrics in fluorine-based plasma gases. The supercritical carbon dioxide may include an oxidizer in one embodiment.

4 Claims, 1 Drawing Sheet

CLEANING RESIDUES FROM SEMICONDUCTOR STRUCTURES

BACKGROUND

This invention relates generally to processes for manufacturing semiconductor integrated circuits and, particularly, to the removal of etch residues and copper oxides from copper lines.

Fluorine-based plasma etching is commonly used to etch photoresist to generate patterns on a semiconductor device. A residue is left behind on the etched wafer that essentially includes constituents of the plasma gas and the material etched. Normally, gases composed of carbon and fluorine are used for plasma etching resulting in a residue made of carbon and fluorine. Further, the residue may be polymerized due to the generation of free radicals and ions in the high-energy plasma environment.

Particularly with photoresists in advanced semiconductor processes, such as the 193 nm photoresist, wherein a fluorine-rich plasma etch is used, and with 157 nm, in which case the photoresist itself being fluorine-based. This residue may include carbon, hydrogen, and fluorine, and is highly chemically inert and is, therefore, relatively difficult to remove with conventional wet chemical etches. The use of delicate interlayer dielectrics, including porous materials, may prevent the use of ashing for residue removal. Conventional wet cleans may not work well with this relatively inert chemical residue. Few liquid solvents can penetrate fluorine-based polymers like teflon, or even the cross-linked and damaged residue and remaining organic stack.

Thus, there is a need for a better way to remove resistant etch residues.

DETAILED DESCRIPTION

Supercritical carbon dioxide has gas-like diffusivity and viscosity and liquid-like densities, while being almost chemically inert. Hence a host of chemically reactive agents may almost always be used in conjunction during supercritical carbon dioxide-based cleans. Carbon dioxide becomes supercritical at temperatures above 30° C. and pressures above 1000 pounds per square inch. A fluid is considered to be supercritical when it is no longer possible to return it to its liquid state by an increase in pressure.

Fluorine-based and siloxane-based polymers interact favorably with supercritical carbon dioxide. Supercritical carbon dioxide can dissolve a fluorine-based polymer based on the molecular weight, cross-linking density, and side groups involved. Further, small chains of fluorocarbons, such as perfluoroalkanes, perfluoroaromatics, and perfluoro-cyclohydrocarbons, are soluble in supercritical carbon dioxide and can be used as co-solvents.

Dissolved fluorocarbons in supercritical carbon dioxide may be quickly transported into residues left after fluorine-based etches of photoresist due to the high diffusivity of supercritical carbon dioxide and, particularly, the diffusivity of supercritical carbon dioxide in polymers and small molecules in polymers swollen by supercritical carbon dioxide. Since the fluorocarbons are chemically similar to the etch residue, the etch residue swells. This further increases the access of the supercritical carbon dioxide into the interior of the etch residue and weakens the residue. The fluorocarbon also breaks into the hard crust of the residue, which the supercritical carbon dioxide by itself may be unable to enter and swell, to introduce the reactive agents into the residue.

A variety of chemically reactive agents are soluble in supercritical carbon dioxide, such as the solvents dimethyl acetamide (DMAC), sulfolane, organic peroxides, ethers, glycols, organic bases, and strong organic and mineral acids, to mention a few examples. The higher degree of swelling of the fluorine-based residue by fluorocarbons dissolved in supercritical carbon dioxide and increased diffusion of supercritical carbon dioxide and the dissolved reagents therein (fluorocarbons and the other chemical reagents) may enhance residue deterioration and removal. A high flow rate of supercritical carbon dioxide may lend the ability to use highly reactive chemicals as opposed to conventional wet chemistries, which have a long contact time with the dielectric material.

Thus, the supercritical carbon dioxide plus fluorocarbons and chemical reagents may be used to attack residues remaining after etches, such as fluorine-based plasma etches of photoresist. The residue may swell as a result of interaction with the supercritical carbon dioxide, with the fluorocarbon aiding in the swelling process, or with other components. The supercritical carbon dioxide may act as a carrier and an additional swelling agent.

Figure 1:
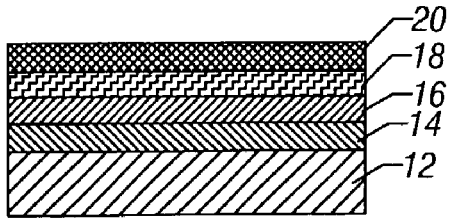
FIG. 1 is an enlarged cross-sectional view of a portion of a wafer with a resistant skin or etch polymer in accordance with one embodiment of the present invention.

Referring to FIG. 1, a silicon wafer 12 may be covered by an interlayer dielectric 14, an antireflective coating (ARC) 16, a bulk photoresist 18, and a resist skin or etch polymer 20 in one embodiment. The dielectric may, for example, be any dielectric including a low K dielectric, porous dielectric, or a non-porous dielectric. The resist skin or etch polymer 20 may have been modified as a result of etching and may constitute an etch residue or other material intended to be removed, but portions of which still remain. The resist skin or etch polymer 20 may include a polymer residue with relatively longer chain molecules in some cases, cross-linked, branched, hyper branched, or oligomeric in nature.

Examples of polymeric residues include perfluoro polymeric-oligomeric species that are difficult to remove from the substrate without impacting underlying device features. The polymer etch species and the hardened photoresist layer combined skin, making up the layers 18 and 20, may be especially resistant to chemical removal techniques. For example, where the dielectric 14 is relatively low dielectric constant dielectric, such as carbon doped oxide (CDO) or other porous silicon-based interlayer dielectrics, it may be damaged by conventional techniques used to remove the resist skin or etch polymer 20 and bulk photoresist 18.

The bulk photoresist 18 and the resist skin and etch polymer 20 may be chemically modified to degrade the polymer residue into shorter molecular species, to reduce the number of crosslink sites and to chemically modify the polymer to increase the oxidation content of the compound. One or more of these processes may be achieved through an oxidation treatment that facilitates the removal of the undesired material from the wafer 12.

Oxidation introduces a functionality that increases the solvency of fluoropolymers in a cleaning medium. The crosslinked species, generated during the etch or during other process steps, can be degraded into smaller molecular species as a result of oxidation. The solubility of the resistant material is a function of crosslink density and molecular weight. Thus, oxidation of polymer species may decrease crosslink density by degrading these links or by breaking the macromolecule into smaller segments enabling the species to be more effectively cleaned and removed from the wafer 12.

Likewise, chemical modification of these species may also increase the solubility of the molecules in some embodiments. Polymeric species that are chemically modified with increased oxygen content, or that have undergone oxidative reactions, may have improved interaction with solvents or other chemical species. The oxidized material may also increase the absorption of chemicals into the polymer matrix, thereby improving the efficiency of the cleaning chemistry, in addition to reducing the time and temperature that might alternatively have been used to clean the wafer 12.

In some embodiments, incorporating the oxidizing chemistry in supercritical or liquid carbon dioxide phases takes advantage of the low surface tension, gas-like diffusivity, and chemical inertness of the medium. Perfluorinated compounds and siloxanes are soluble in carbon dioxide media. However, linear, branched, and crosslinked polymers and residues may only be swelled, which is still a benefit as swelling can help transport solvent and other active chemicals into the polymer interior.

Chemically modified polymer chains with the appropriate functionality, size, and molecular structure can be dissolved in this carbon dioxide medium. Introducing cosolvents and chemicals or active agents to modify the polymers in the carbon dioxide medium may reduce the deleterious impact of exposing, on a classical wet bench, dielectric films to bulk chemicals.

Figure 2:
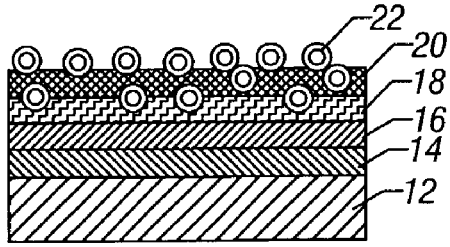
FIG. 2 is an enlarged cross-sectional view of the portion shown in FIG. 1 after further processing in accordance with one embodiment of the present invention.
Figure 3:
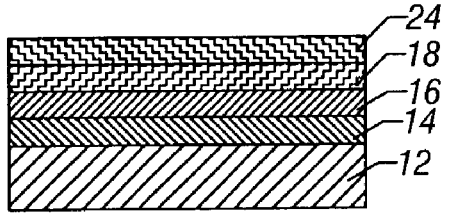
FIG. 3 is an enlarged cross-sectional view of the embodiment shown in FIG. 2 after further processing in accordance with one embodiment of the present invention.

The structure shown in FIG. 1 may be subject to chemical oxidation in a flowing supercritical or liquid carbon dioxide medium. As a result, the resist skin and etch polymer 20 may be oxidized, as indicated at 22 in FIG. 2, as may be the bulk photoresist 18. Eventually, an oxidized layer 24, shown in FIG. 3, is all that remains of the resist skin and etch polymer 20.

Figure 4:
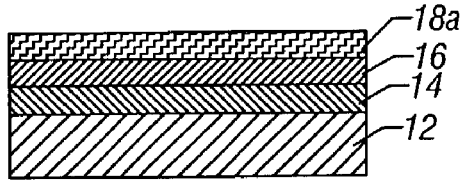
FIG. 4 is an enlarged cross-sectional view of the embodiment shown in FIG. 3 after further processing in accordance with one embodiment of the present invention.
Figure 5:
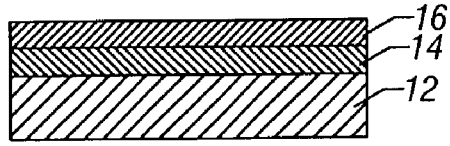
FIG. 5 is an enlarged cross-sectional view of the embodiment shown in FIG. 4 after further processing in accordance with one embodiment of the present invention.
Figure 6:
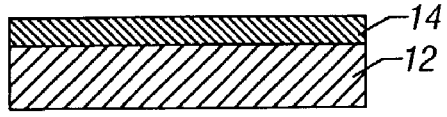
FIG. 6 is an enlarged cross-sectional view of the embodiment shown in FIG. 5 after further processing in accordance with one embodiment of the present invention.

Thereafter, conventional cleaning solvents or chemistry in a carbon dioxide medium may be flowed over the wafer to remove the oxidized layer 24, leaving an oxidized bulk resist layer 18, as shown in FIG. 4. Different or the same clean chemistry may then be flowed again using carbon dioxide media to remove the oxidized bulk resist 18 as shown in FIG. 5. Addition of appropriate cleaning solvents or chemistry may be applied to remove the remaining antireflective coating 16 to achieve the structure shown in FIG. 6.

In one embodiment of the present invention, a variety of different materials may be applied in the supercritical carbon dioxide to attack the resist skin and etch polymer 20. These chemicals are oxidizing agents that may be soluble or insoluble in the supercritical carbon dioxide. For example, in one embodiment, ten milliliters of hydrogen peroxide and three drops of twenty-four percent ammonium fluoride in the supercritical carbon dioxide may be utilized in a structure that uses porous carbon dioxide as the interlayer dielectric 14. A rinse step with seventeen milliliters of organic solvent may follow the processes illustrated.

In some embodiments, the chemical responsible for oxidation is homogeneously distributed through the reaction medium including supercritical carbon dioxide. The reaction medium may also contain co-solvents that facilitate penetration into the polymer stack. In some embodiments, homogeneously distributing the oxidation generating material may be advantageous since the active chemical may be present throughout the entire thickness of the stack.

In accordance with another embodiment of the present invention, the oxidation chemical may have limited solubility in the carbon dioxide medium. As a result, the oxidation chemical may be deposited on the substrate as a second phase. In some embodiments, this technique may have the advantage of allowing the upper surface of the stack to be chemically modified without deleterious reactions on sensitive layers where modification is not desirable.

In still another embodiment of the present invention, oxidation can be facilitated by the addition of free radical generators. The free radicals are responsible for reactions like hydrogen atom abstraction, and the resulting radical is terminated with $O_2$, where the resulting species can facilitate additional hydrogen atom abstraction, radical-radical coupling, chain scission reactions, or functionality changes. The free radical source may be homogeneously distributed through the medium so as to have access to the entire stack in one embodiment.

In another embodiment, the free radical generator may have limited solubility in the carbon dioxide medium and, hence, may be deposited on the substrate as a second phase. This technique may have the advantage, in some cases, of allowing the upper surface of the stack to be chemically modified without deleterious reactions on sensitive layers where modification is not desirable. The second phase may be achieved by solubility differences between the free radical generator and the carbon dioxide medium induced through pressure, temperature, co-solvent contributions, or by inherent chemical structure.

In still another embodiment, a chromophore may be added to the carbon dioxide medium to accept light or other energy that is introduced via a view cell. The chromophore is in turn quenched by oxygen molecules. The energy transfer process from the chromophore to oxygen transforms triplet oxygen to singlet oxygen, which is energetically capable of chemical reaction with the stack. Achi singlet oxygen can be generated by direct excitation also.

In still another embodiment, ozone may be utilized with the carbon dioxide medium. The ozone may be distributed homogeneously through the reaction medium. An advantage of this technique is that the ozone is present through the entire thickness of a stack. The complexity of the chemical composition may also be simplified by utilizing a reactive form of oxygen to react directly with the stack.

In yet another embodiment of the present invention, a catalyst, bound or unbound by a support, may be introduced in the carbon dioxide medium, either alone or with oxygen gas.

While the present invention has been described with respect to a limited number of embodiments, those skilled in the art will appreciate numerous modifications and variations therefrom. It is intended that the appended claims cover all such modifications and variations as fall within the true spirit and scope of this present invention.

What is claimed is:

1. A cleaner comprising:

supercritical carbon dioxide;

a free radical generator having limited solubility in said supercritical carbon dioxide such that the free radical generator is deposited on an object to be cleaned; and at least one oxidizer having limited solubility in supercritical carbon dioxide such that the oxidizer is deposited on the object to be cleaned.

2. The cleaner of claim 1 including ozone.

3. The cleaner of claim 1 including a catalyst.

4. The cleaner of claim 3 including oxygen gas.

* * * * *